US011774172B2

(12) United States Patent
Dubina et al.

(10) Patent No.: US 11,774,172 B2
(45) Date of Patent: Oct. 3, 2023

(54) DRAWER IN A REFRIGERATOR DOOR

(71) Applicant: Electrolux Home Products, Inc., Charlotte, NC (US)

(72) Inventors: Paul Dubina, Columbia, SC (US); Andrew D. Brown, Anderson, SC (US); Jason Burriss, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 17/356,889

(22) Filed: Jun. 24, 2021

(65) Prior Publication Data

US 2022/0412643 A1 Dec. 29, 2022

(51) Int. Cl.

| | |
|---|---|
| ***F25D 23/02*** | (2006.01) |
| ***F25D 25/02*** | (2006.01) |
| *E05C 1/12* | (2006.01) |
| *F25D 23/04* | (2006.01) |

(52) U.S. Cl.

CPC ..... *F25D 25/025* (2013.01); *F25D 23/025* (2013.01); *E05C 1/12* (2013.01); *E05Y 2900/31* (2013.01); *F25D 23/028* (2013.01); *F25D 23/04* (2013.01); *F25D 2323/02* (2013.01); *F25D 2323/023* (2013.01)

(58) Field of Classification Search

CPC ..... F25D 25/025; F25D 2323/02; F25D 2323/023; F25D 23/04; F25D 23/025; E05Y 2900/31

See application file for complete search history.

(56) References Cited

U.S. PATENT DOCUMENTS

| | | | | |
|---|---|---|---|---|
| 3,878,693 | A | 4/1975 | Prada | |
| 4,087,140 | A * | 5/1978 | Linstromberg | F25D 25/025 312/273 |
| 6,253,568 | B1 | 7/2001 | Peffley | |
| 6,449,976 | B1 | 9/2002 | Chai et al. | |
| 7,197,888 | B2 | 4/2007 | LeClear et al. | |
| 7,261,385 | B2 * | 8/2007 | Weinberger | A47B 88/70 312/298 |
| 7,380,410 | B2 | 6/2008 | Rand et al. | |
| 7,744,173 | B2 * | 6/2010 | Maglinger | F25C 5/182 62/344 |
| 8,002,367 | B2 | 8/2011 | Kim et al. | |

(Continued)

FOREIGN PATENT DOCUMENTS

| | | | |
|---|---|---|---|
| CN | 202675779 U | * | 1/2013 |
| CN | 104896860 A | * | 9/2015 |

(Continued)

OTHER PUBLICATIONS

International Search Report and Written Opinion for PCT/2022/028739, dated Aug. 18, 2022, 13 pages.

*Primary Examiner* — Kimberley S Wright
(74) *Attorney, Agent, or Firm* — Pearne & Gordon LLP

(57) ABSTRACT

A refrigerator appliance includes a cabinet and a storage compartment with a drawer assembly disposed therein. One or more storage compartment doors are pivotally coupled to the cabinet to restrict or gain access to the storage compartment. At least one of the doors defines an opening that is shaped and dimensioned to enable the drawer assembly to be extended and retracted through the opening.

17 Claims, 9 Drawing Sheets

(56) References Cited

U.S. PATENT DOCUMENTS

| | | | | |
|---|---|---|---|---|
| 8,157,338 | B2 * | 4/2012 | Seo | A47B 88/40 312/301 |
| 8,162,422 | B2 * | 4/2012 | Kim | F25D 23/021 312/301 |
| 8,277,004 | B2 | 10/2012 | Chung | |
| 8,302,423 | B2 | 11/2012 | Lee et al. | |
| 8,312,735 | B2 | 11/2012 | Fulton | |
| 8,454,103 | B2 | 6/2013 | Jeon et al. | |
| D691,644 | S | 10/2013 | Cho et al. | |
| 8,607,584 | B2 * | 12/2013 | Song | F25D 11/006 312/405.1 |
| 8,707,726 | B2 | 4/2014 | Lim et al. | |
| 8,806,884 | B2 * | 8/2014 | Park | F25D 11/02 62/344 |
| 8,955,352 | B2 * | 2/2015 | Lee | F25D 25/025 312/273 |
| 9,074,810 | B2 | 7/2015 | Hwang et al. | |
| 9,441,872 | B2 | 9/2016 | Park et al. | |
| 9,841,224 | B2 | 12/2017 | Hitzelberger et al. | |
| 10,591,204 | B2 * | 3/2020 | Seo | F25D 23/067 |
| 11,009,277 | B2 * | 5/2021 | Mitchell | F25D 25/025 |
| 2007/0245762 | A1 * | 10/2007 | Maglinger | F25C 5/22 62/344 |
| 2010/0090575 | A1 * | 4/2010 | Uthuppan | F25D 23/04 312/404 |
| 2010/0219730 | A1 * | 9/2010 | Watts | A47B 67/04 312/404 |
| 2011/0006655 | A1 * | 1/2011 | Seo | A47B 88/45 312/402 |
| 2011/0094256 | A1 * | 4/2011 | Song | F25D 23/025 29/890.035 |
| 2012/0060544 | A1 * | 3/2012 | Lee | F25D 25/025 312/404 |
| 2016/0084560 | A1 | 3/2016 | Jeong et al. | |
| 2016/0356543 | A1 | 12/2016 | Park et al. | |
| 2017/0138659 | A1 | 5/2017 | Lee et al. | |
| 2017/0234607 | A1 | 8/2017 | Yang et al. | |
| 2017/0314846 | A1 | 11/2017 | Yu et al. | |
| 2017/0350642 | A1 | 12/2017 | Yang et al. | |
| 2018/0038632 | A1 | 2/2018 | Yang et al. | |

FOREIGN PATENT DOCUMENTS

| | | | | |
|---|---|---|---|---|
| CN | 106705556 A | * | 5/2017 | |
| CN | 106121448 B | * | 1/2018 | F25D 25/025 |
| CN | 212205250 U | * | 12/2020 | |
| JP | S5738187 | | 3/1982 | |
| JP | 2004323043 A | * | 11/2004 | |
| KR | 20190104109 | | 9/2019 | |

* cited by examiner

DRAWER IN A REFRIGERATOR DOOR

FIELD OF THE INVENTION

This application relates generally to a refrigerator appliance including a drawer assembly, and more particularly, to a refrigerator appliance including a drawer assembly that may be extended or retracted through an opening formed in a refrigerator compartment door.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

In most refrigerator appliances, the fresh food compartment includes a plurality of elongated shelves extending between opposing side walls thereof. Due to the configuration of the fresh food compartment, food items placed on the shelves are generally arranged in a front to rear manner. This lends itself to undesirable waste since many consumers cannot readily see food items placed behind other items on a shelf, thereby causing such food items to expire. Additionally, retrieving a food item placed on a rear portion of a shelf can be cumbersome since a user must generally rearrange other items on the shelf to retrieve the desired food item.

Moreover, when retrieving a food item, a user must open at least an entire fresh food compartment door resulting in cold air escaping the fresh food compartment. This compromises the thermal efficiency of a refrigerator appliance because a compressor thereof must operate to re-cool the air in the fresh food compartment. Thus, there exists a need to provide a storage solution for a fresh food compartment that makes food items more accessible and that conserves the energy of the appliance.

BRIEF SUMMARY OF THE INVENTION

The following presents a simplified summary of the disclosure in order to provide a basic understanding of some example aspects described in the detailed description. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

In accordance with one aspect, there is provided a refrigerator appliance including a storage compartment with a drawer assembly. A refrigerator door is coupled to the storage compartment to restrict or grant access thereto. The door defines an opening that is shaped and dimensioned to enable the drawer assembly to be extended or retracted therethrough. The drawer assembly includes a front panel with a handle, and a container defining a storage space for food items. The handle is operable to selectively couple the container to the front panel such that the container may be extended or retracted through the opening in the door.

It is to be understood that both the foregoing general description and the following detailed description present embodiments of the present disclosure, and are intended to provide an overview or framework for understanding the nature and character of the embodiments as they are described and claimed. The accompanying drawings are included to provide a further understanding of the embodiments, and are incorporated into and constitute a part of this specification. The drawings illustrate various embodiments of the disclosure and together with the description serve to explain the principles and operations thereof.

BRIEF DESCRIPTION OF THE DRAWINGS

These and other features, aspects and advantages of the present disclosure can be further understood when read with reference to the accompanying drawings.

DESCRIPTION OF EXAMPLE EMBODIMENTS

Figure 1:
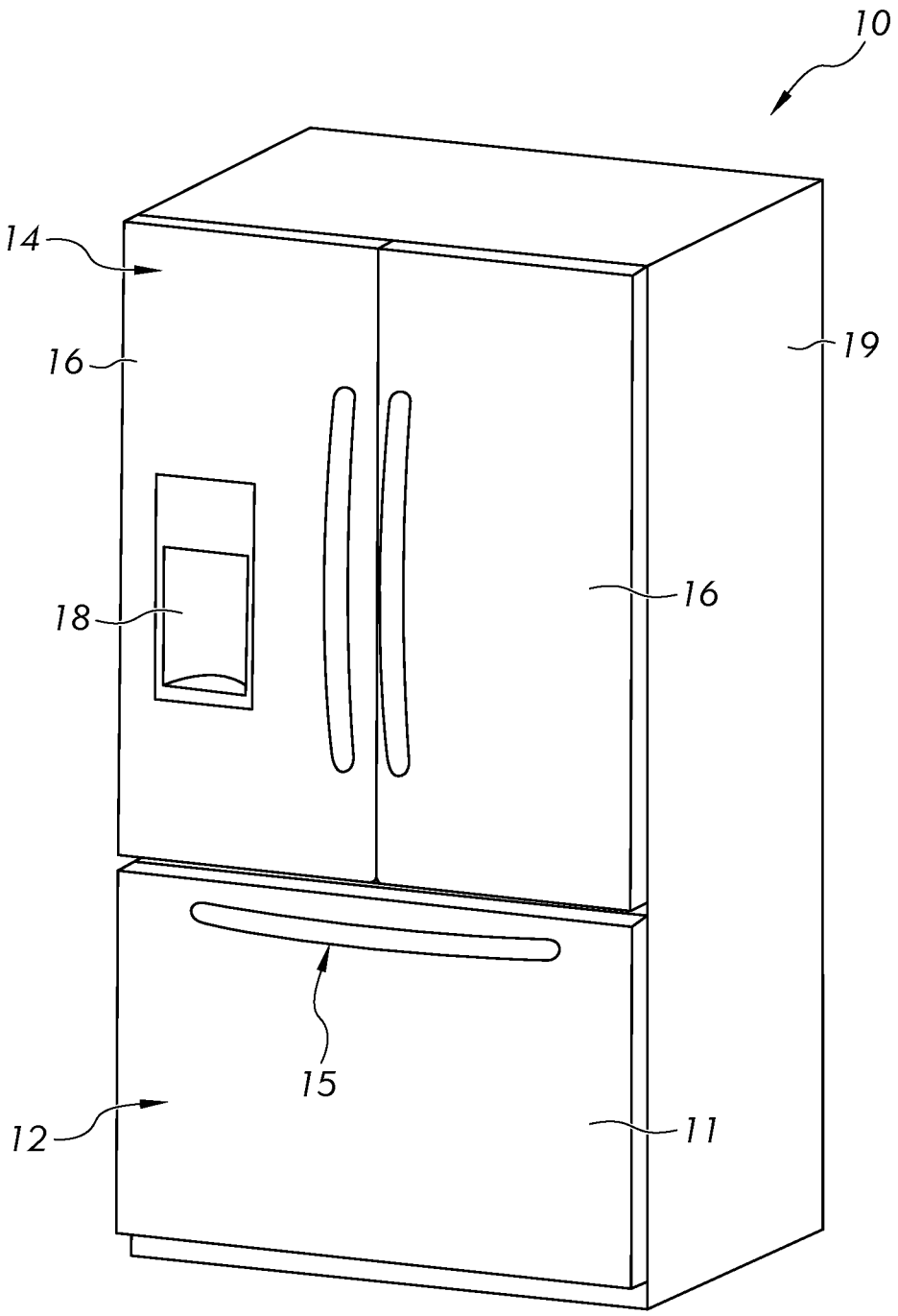
FIG. 1 is a front perspective view of a household French Door Bottom Mount refrigerator wherein doors of the refrigerator are in a closed position.

Apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food storage compartment 14 disposed vertically above a freezer storage compartment 12. However, the refrigerator 10 can have any desired configuration including at least one of a fresh food storage compartment 14 and/or a freezer storage compartment 12, such as a top mount refrigerator (freezer disposed above the fresh food compartment), a side-by-side refrigerator (fresh food compartment is laterally next to the freezer compartment), a standalone refrigerator or freezer having a single main compartment, etc.

Figure 2:
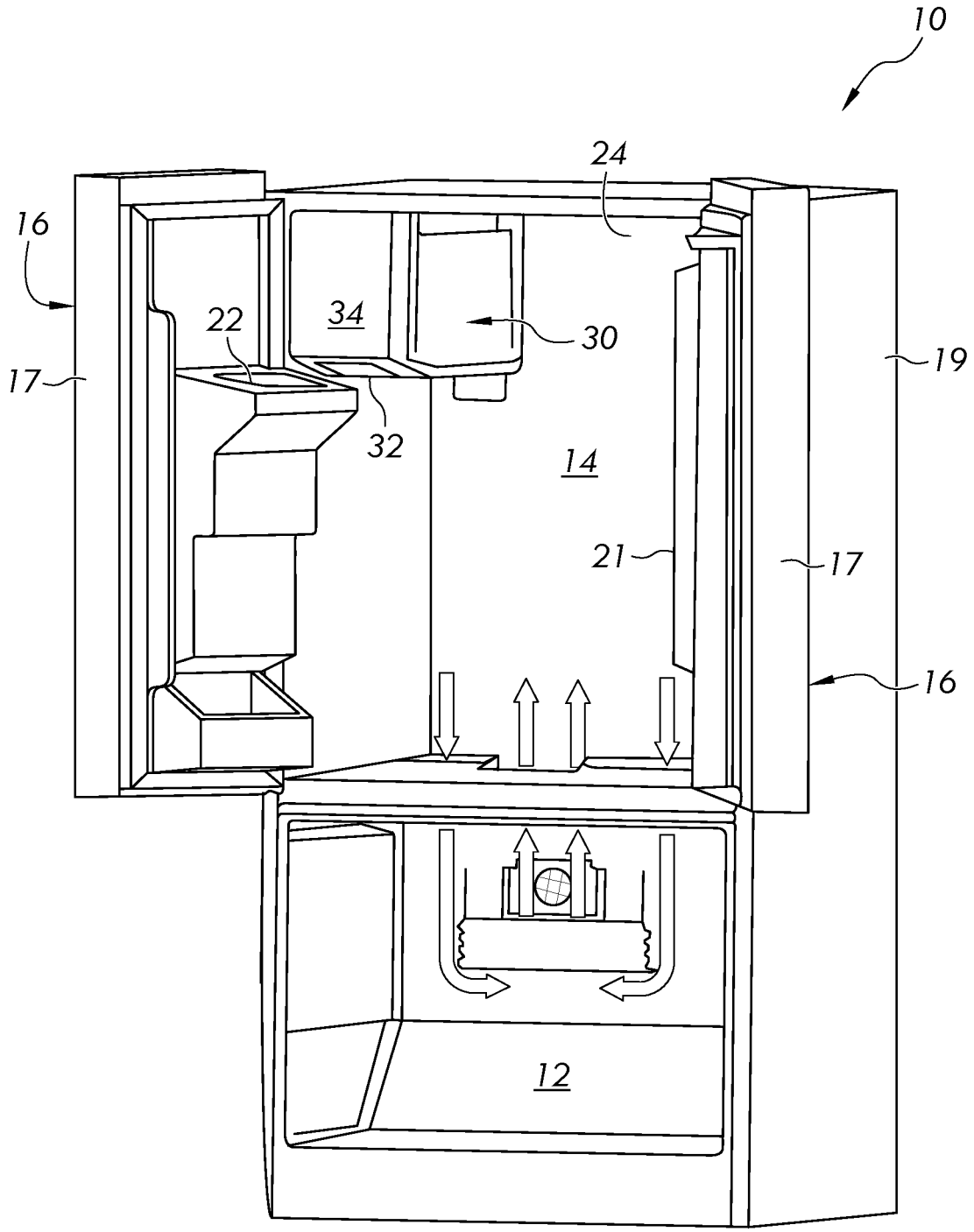
FIG. 2 is a front perspective view of the refrigerator of FIG. 1 showing the doors in an opened position and an interior of a fresh food compartment.

One or more doors 16 shown in FIG. 1 are pivotally coupled to a cabinet 19 of the refrigerator 10 to restrict and grant access to the fresh food storage compartment 14. The door 16 can include a single door that spans the entire lateral distance across the entrance to the fresh food storage compartment 14, or can include a pair of French-type doors 16 as shown in FIG. 1 that collectively span the entire lateral distance of the entrance to the fresh food storage compartment 14 to enclose the fresh food storage compartment 14. For the latter configuration, a center flip mullion 21 (FIG. 2) is pivotally coupled to at least one of the doors 16 to establish a surface against which a seal provided to the other one of the doors 16 can seal the entrance to the fresh food storage compartment 14 at a location between opposing side surfaces 17 (FIG. 2) of the doors 16. The mullion 21 can be pivotally coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation. The seal and the externally-exposed surface of the mullion 21 cooperate approximately midway between the lateral sides of the fresh food storage compartment 14.

A dispenser 18 (FIG. 1) for dispensing at least ice pieces, and optionally water, can be provided on an exterior of one of the doors 16 that restricts access to the fresh food storage compartment 14. The dispenser 18 includes an actuator (e.g., lever, switch, proximity sensor, etc.) to cause frozen ice pieces to be dispensed from an ice bin 34 (FIG. 2) of an ice maker 30 disposed within the fresh food storage compartment 14. Ice pieces from the ice bin 34 can exit the ice bin 34 through an aperture 32 and be delivered to the dispenser 18 via an ice chute 22 (FIG. 2), which extends at least partially through the door 16 between the dispenser 18 and the ice bin 34.

Referring to FIG. 1, the freezer storage compartment 12 is arranged vertically beneath the fresh food storage compartment 14. A drawer assembly (not shown) including one or more freezer baskets (not shown) can be withdrawn from the freezer storage compartment 12 to grant a user access to food items stored in the freezer storage compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer storage compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer storage compartment 12 is used to freeze and/or maintain articles of food stored in the freezer storage compartment 12 in a frozen condition. For this purpose, the freezer storage compartment 12 is in thermal communication with a freezer evaporator (not shown) that removes thermal energy from the freezer storage compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food storage compartment 14. The fresh food storage compartment 14 is located in the upper portion of the refrigerator 10 in this example and serves to minimize spoiling of articles of food stored therein. The fresh food storage compartment 14 accomplishes this by maintaining the temperature in the fresh food storage compartment 14 at a cool temperature that is typically above 0° C., so as not to freeze the articles of food in the fresh food storage compartment 14. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator can also be blown into the fresh food storage compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food storage compartment 14 independent of the freezer storage compartment 12. According to an embodiment, the temperature in the fresh food storage compartment 14 can be maintained at a cool temperature within a close tolerance of a range between 0° C. and 4.5° C., including any subranges and any individual temperatures falling with that range. For example, other embodiments can optionally maintain the cool temperature within the fresh food storage compartment 14 within a reasonably close tolerance of a temperature between 0.25° C. and 4° C.

Figure 3:
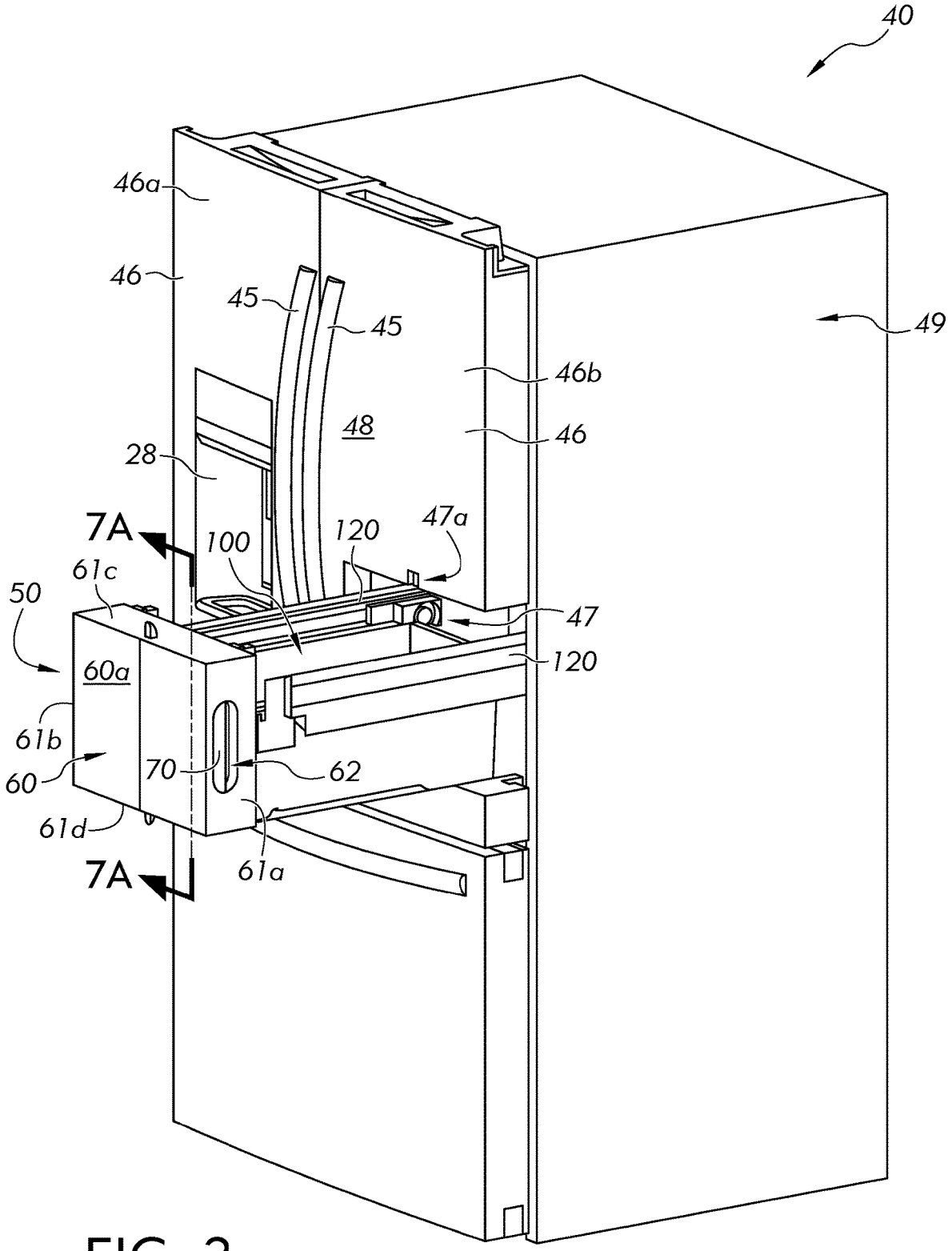
FIG. 3 is a front perspective view of a household refrigerator according to another embodiment including an example drawer assembly as disclosed herein.

Turning now to FIG. 3, a refrigerator appliance 40 according to a second embodiment is shown with an example drawer assembly 50 as disclosed herein. The refrigerator appliance 40 according to the second embodiment shares similar features with the refrigerator appliance 10 of the first embodiment. Therefore, a detailed description of duplicate features has been omitted for brevity. The appliance 40 includes a pair of fresh food compartment doors 46 that are pivotally coupled to a cabinet 49 of the appliance 40 to restrict or grant access to a fresh food storage compartment 44 (FIG. 7B) defined therein. Each door 46 includes an elongated handle 45 attached thereto that is operable to open and close the respective door 46. In distinction to the refrigerator appliance of the first embodiment, one of the doors 46 defines an opening 47 that is shaped and dimensioned to enable the drawer assembly 50 located in the fresh food compartment 44 to be extended or retracted through the door 46. Although the examples herein illustrate the opening 47 formed in the right door 46*b*, it is contemplated that the left door 46*a* could similarly define an opening for enabling the drawer assembly 50 to be extended therethrough, e.g., in such embodiments wherein the dispenser 28 is located on the right door 46*b*. Moreover, it is also contemplated that multiple drawer assemblies 50 may be arranged variously inside respective portions of the fresh food compartment with each drawer assembly corresponding to a respective opening formed in the door.

In general, the drawer assemblies described herein provide consumers a storage space that is readily accessible and more convenient for retrieving food items stored therein. In the illustrated embodiment, the drawer assembly 50, in general, includes a front panel 60, a basket 100 for storing food items, and a pair of extendable slides 120 that enable the drawer assembly 50 to be extended or retracted through the opening 47 formed in the door 46. While the illustrated embodiments depict a molded perforated basket 100 (FIG. 4) for storing food items, it should be understood that the basket 100 may embody other forms of storage containers, e.g., a bin having solid walls, a crisper drawer, a wire-form basket, etc.

Figure 7A:
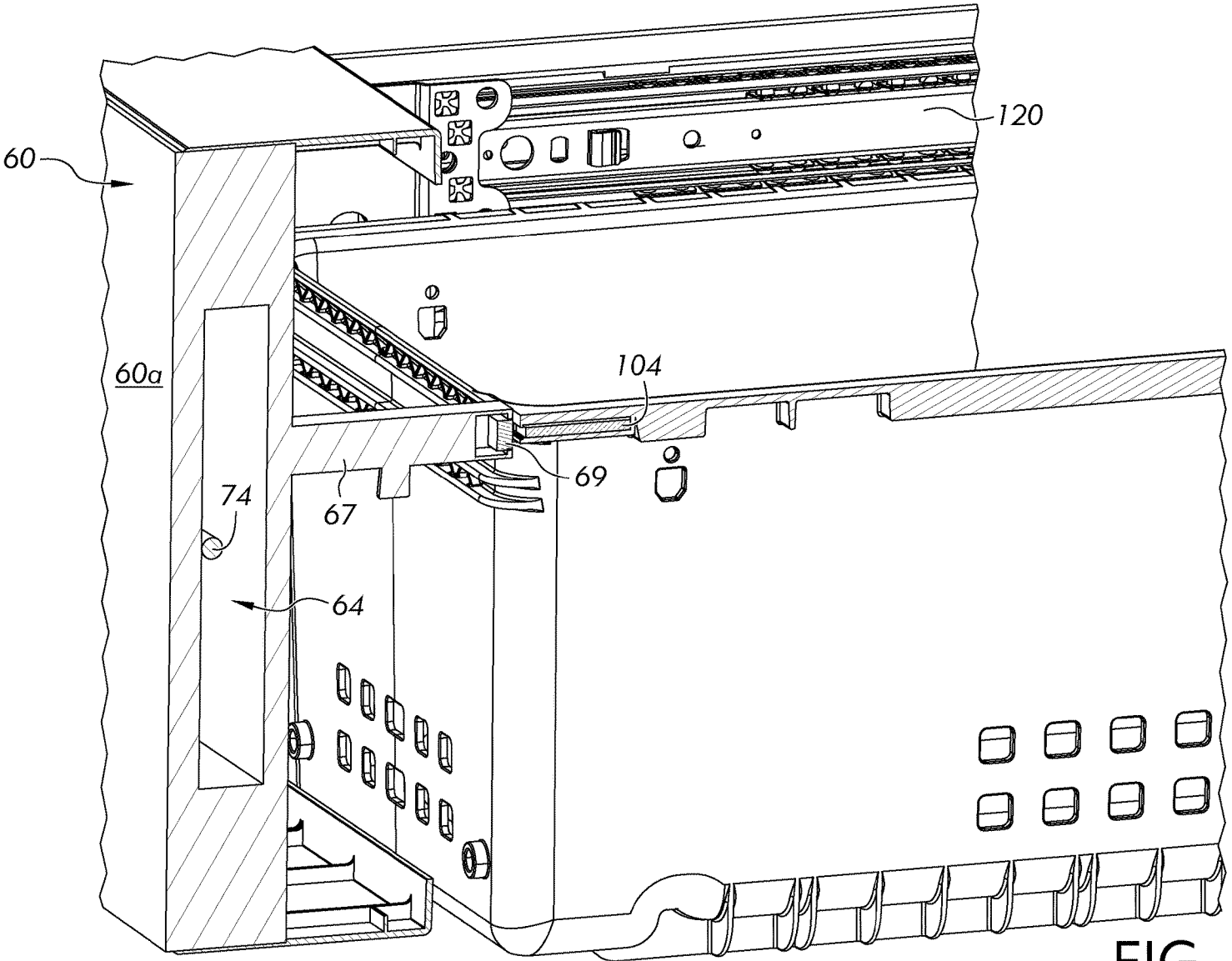
FIG. 7A is closeup, partial side sectional view of the drawer assembly taken along line 7A-7A of FIG. 3.
Figure 7B:
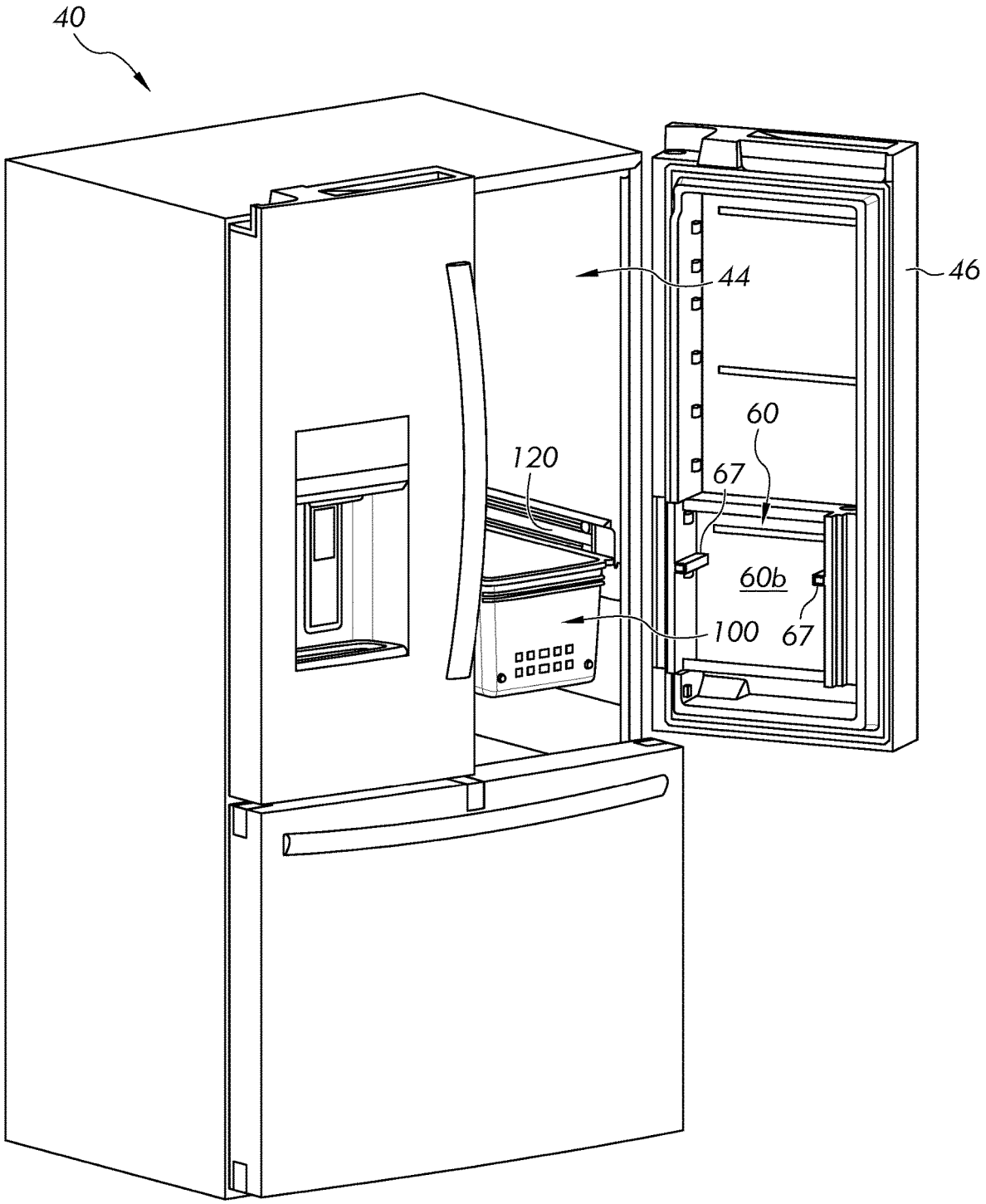
FIG. 7B is a front perspective view of the refrigerator of FIG. 3, wherein a refrigerator door is shown swung open with a front panel of the drawer assembly coupled thereto.

Still referring to FIG. 3, the front panel 60 generally embodies a box-shaped enclosure including a front surface 60*a*, a rear surface 60*b* (FIG. 7B), and a plurality of exposed edge portions 61*a-d* extending between the front surface 60*a* and the rear surface 60*b*. The front surface 60*a* is formed to be substantially flush with a front surface 48 of the fresh food compartment door 46*b* when the drawer assembly 50 is fully retracted (e.g., pushed in) such there is little to no gap therebetween. In this manner, the front panel 60 and the opening 47 in the door 46*b* are correspondingly dimensioned to inhibit cold air from escaping the fresh food compartment 44 when the drawer assembly 50 is in a fully retracted state. Additionally, the front panel 60 will include some foam insulation (not shown) to inhibit heat transfer, including any of expanded foam insulation, rigid foam insulation, and/or vacuum insulated panel(s). It is also contemplated that a seal or gasket (not shown) may be disposed about a periphery of the opening 47 to inhibit cold air from escaping the fresh food compartment 44 when the drawer assembly 50 is in a fully retracted state. Such a seal or gasket could be provided variously upon the front panel 60, such as around an exterior periphery of thereof for engagement with corresponding surfaces of the door 46 and/or could be provided upon an interior-facing surface of the front panel 60 for engagement with the cabinet of the refrigerator. An exposed side 61*a* of the front panel 60 defines an opening 62 for granting access to a handle assembly 70 (FIG. 4) disposed in the front panel 60. In particular, the front panel 60 is formed to define an internal cavity 64 (FIG. 7A) that is shaped and dimensioned to accommodate therein the handle assembly 70 (FIG. 4), a latch assembly 80 (FIG. 4), and a switch 96 (FIG. 4), as described in detail below. Referring to FIGS. 7A and 7B, the rear surface 60*b* of the front panel 60 includes a pair of cantilevered arms 67 extending outwardly therefrom. As shown in FIG. 7A, each arm includes a magnet 69 that is selectively activated or magnetized based on an operation of the handle assembly 70, as described in detail below.

Figure 4:
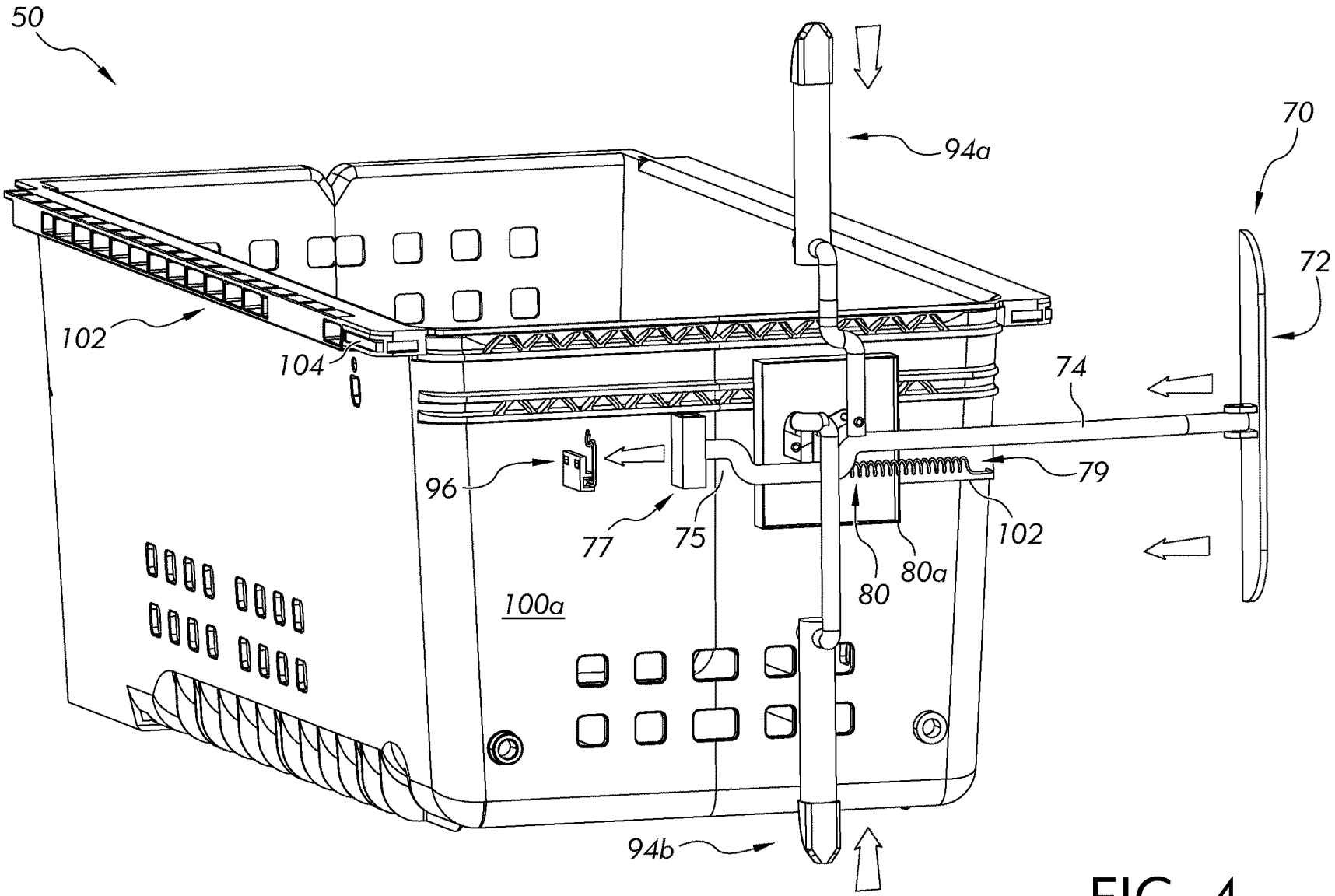
FIG. 4 is a front perspective view of the example drawer assembly of FIG. 3.

Referring to FIG. 4, an example of the drawer assembly 50 is shown without the front panel 60 and the extendable slides 120 for ease of illustrating the handle assembly 70, the latch assembly 80, and the switch 96 disposed in the internal cavity 64 (FIG. 7A) of the front panel 60. The handle assembly 70 includes a handle 72 and a reciprocating rod 74 that is connected to the handle 72, preferably via a removable fastener (e.g., an insertion pin, a screw and a nut, a clip, and the like). The rod 74 is configured to translate linearly (e.g., horizontally to the left as shown) when the handle 72 is depressed or pushed inwardly (e.g., to the left as illustrated) by a user. For the examples described herein, the relative directions (e.g., left, right) and two-dimensional rotations (e.g., clockwise, counterclockwise) are described with respect to the drawer assembly 50 when viewed from a front thereof, as shown in the illustrated embodiments. Yet, it should be appreciated that these orientations could be different in other embodiments without departing from the scope of the present disclosure, for example, when viewing the drawer assembly 50 from a rear view thereof. A spring 79 (e.g., tension spring) is coupled to the rod 74 via a pin 84*c* (FIG. 5B) that is extended through an opening 74*a* of the rod 74. In particular, opposing ends of the spring 79 are connected to the pin 84*c* and to a fixed tab 102 extending outwardly from a main body 80*a* of the latch assembly 80, respectively. The spring 79 is configured to cause or urge the rod 74 and the handle 72 to translate linearly (e.g., horizontally to the right) back to a natural, resting position when the handle is undepressed by a user. In this manner, the handle 72 is naturally biased outwardly in a natural or resting state (e.g., to the right) and will resist the user's action to press the handle 72. Although, in other embodiments, it is contemplated that the spring may cause the handle 72 and the rod 74 to translate inwardly (e.g., to the left) in a natural or resting state, for example, in such embodiments wherein the handle 72 must be pulled to actuate the latch assembly 80.

Still referring to FIG. 4, a magnet 77 is attached to a distal end 75 of the reciprocating rod 74 and is configured to actuate the switch 96 disposed in the internal cavity 64 of the front panel 60, as discussed in detail below. In the illustrated example, the electrical switch 96 embodies a magnetic reed switch that is actuated when exposed to a magnetic field emanating from the magnet 77, e.g., when the reed switch is in close proximity thereto. Of course, various other types of contact or non-contact electrical switches can be utilized that are actuated by direct contact or close proximity to the distal end 75 of the reciprocating rod 74.

Figure 5A:
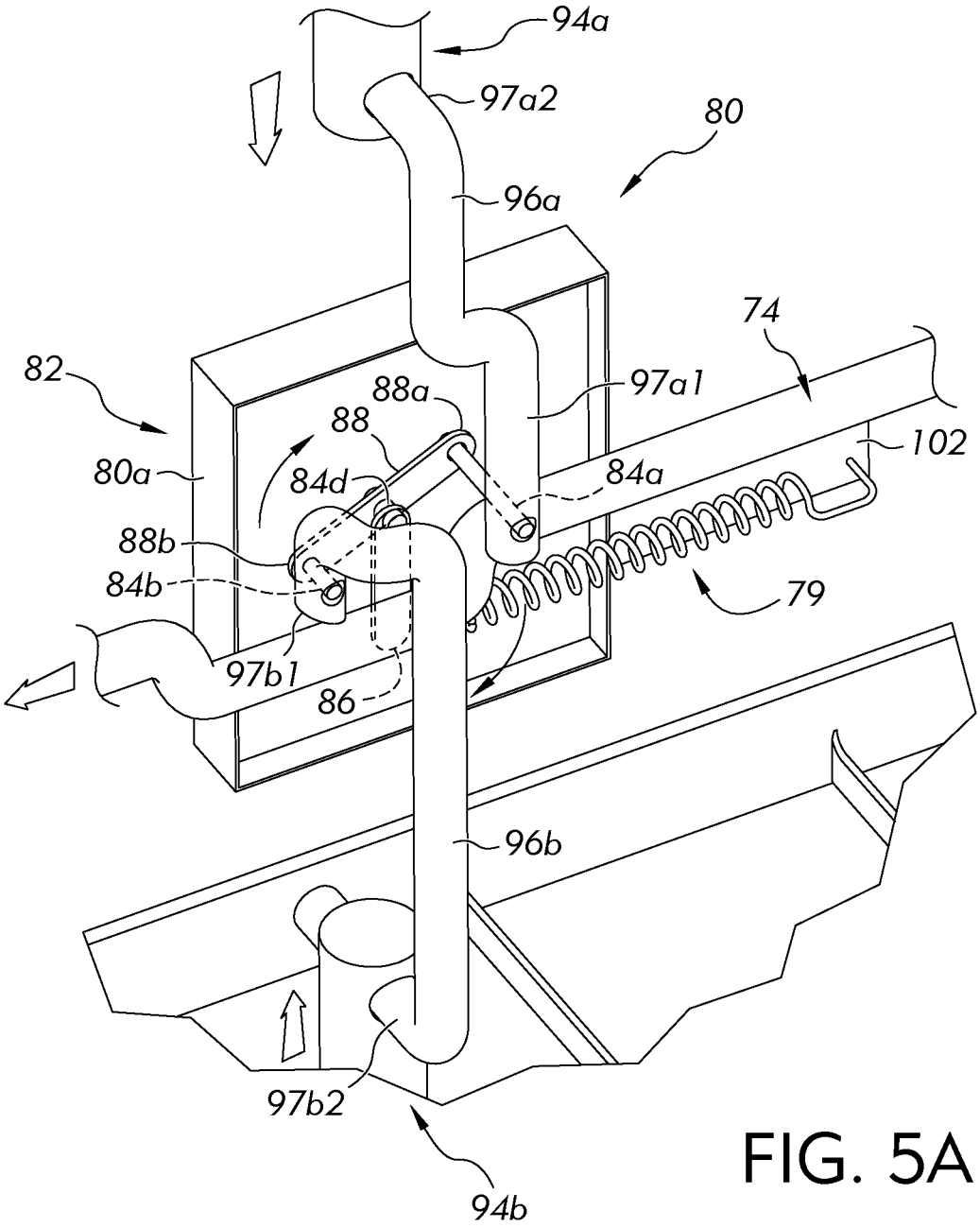
FIG. 5A is a closeup perspective view of a latch assembly of the drawer assembly of FIG. 4 shown in a first or locked state.
Figure 5B:
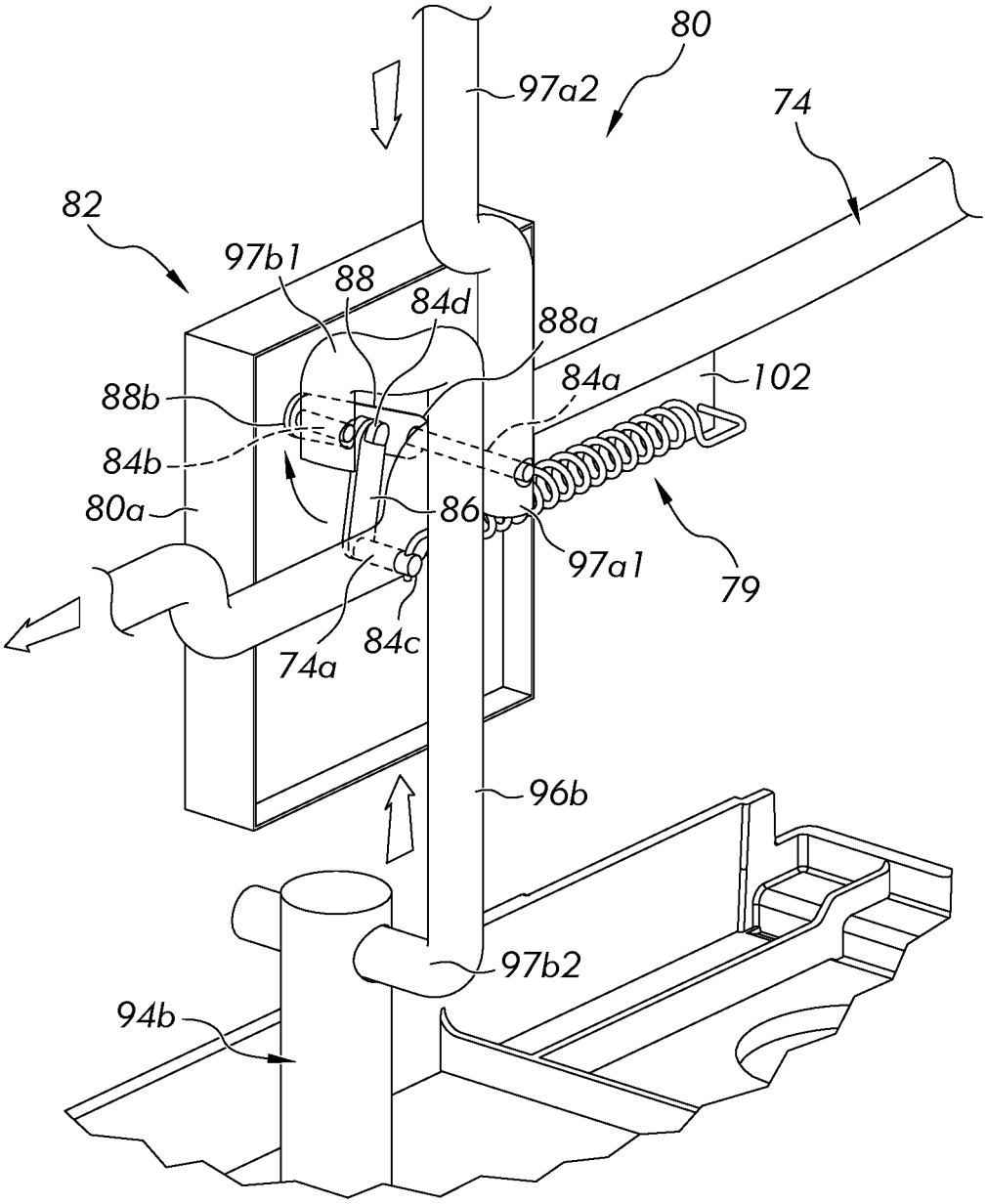
FIG. 5B is a closeup perspective view of the latch assembly of FIG. 5A shown in a second or unlocked state.

Referring to FIGS. 5A and 5B, the latch assembly 80 includes a main body 80*a*, a mechanical linkage 82, a pair of locking bars 94*a*, 94*b*, and a pair of intermediate connectors 96*a*, 96*b*. The mechanical linkage 82 includes a first link 86 and a second link 88 that is angularly offset relative to the first link 86. In the illustrated embodiment, the first and second links 86 and 88 are fixed to each other via a keyed pin 84*d*. In this manner, the second link 88 rotates with the same angular displacement as the first link 86 when it is rotated therewith.

Opposing ends 88*a*, 88*b* of the second link 88 are pivotally coupled to respective, first ends 97*a*1, 97*b*1 of the intermediate connectors 96*a*, 96*b* via coupling pins 84*a*, 84*b*. Meanwhile, the opposite, second ends 97*a*2, 97*b*2 of the intermediate connectors 96*a*, 96*b* are coupled to the locking bars 94*a*, 94*b*, respectively. Based on this arrangement, when the second link 88 is caused to rotate via an operation of the handle 72, the opposing ends 88*a* and 88*b* of the second link 88 will cause the intermediate connectors 96*a*, 96*b* and the locking bars 94*a*, 94*b* to respectively translate vertically toward each other (e.g., when the handle 72 is depressed), or away from each other (e.g., when the handle 72 is released), as discussed in detail below. Although, it should be appreciated that this may be reversed, for example, in such embodiments wherein the intermediate connectors 96*a* and 96*b* and the locking bars 94*a* and 94*b* are configured to translate away from each other when the handle is depressed.

As shown in FIG. 5B, the rod 74 of the handle assembly 70 is pivotally coupled to the first link 86 via the same pin 84*c* that secures the spring 79 to the rod 74. In particular, the pin 84*c* is inserted through the opening 74*a* of the rod 74, and an end of the pin 84*c* is connected to the first link 86.

Figure 6:
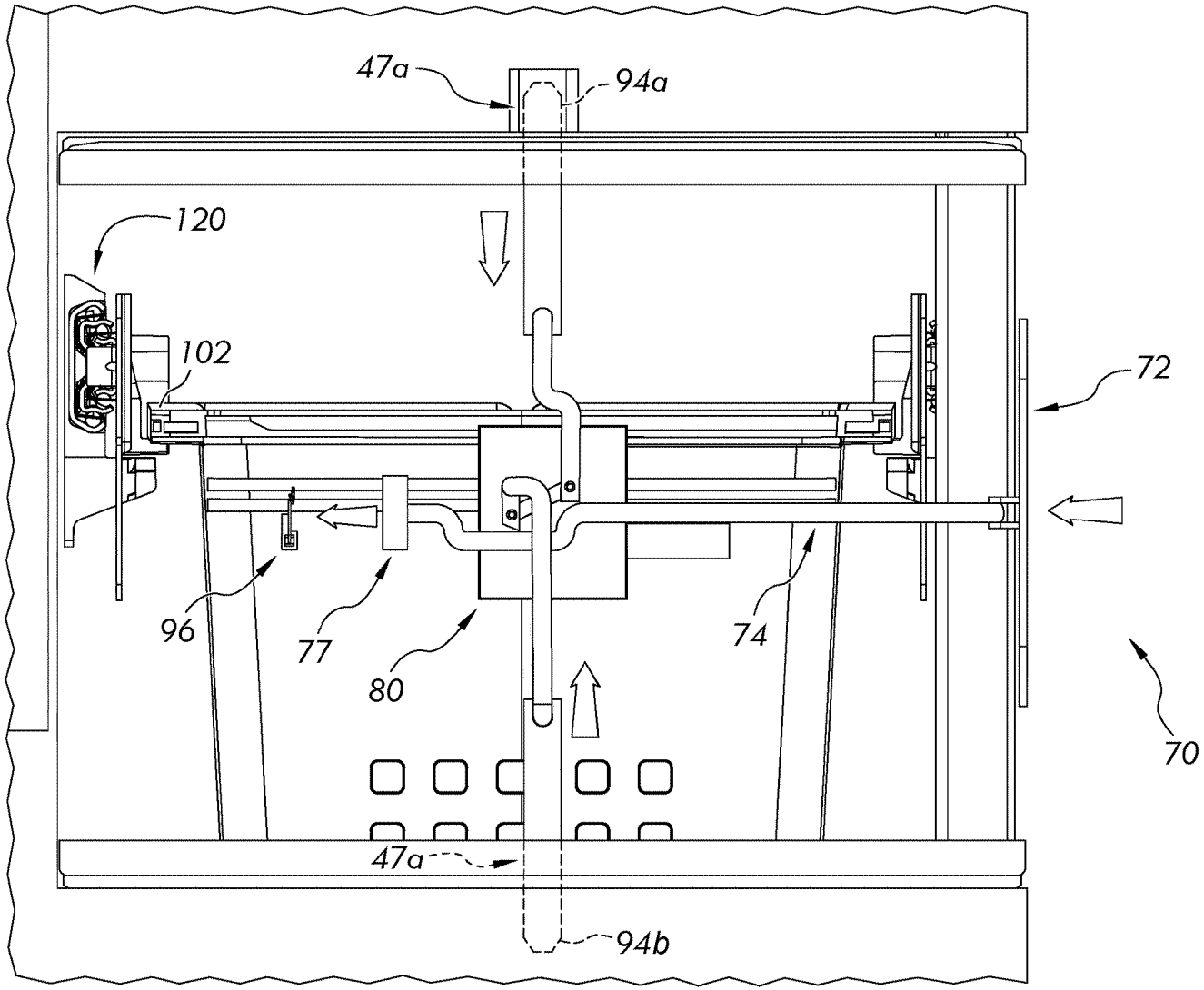
FIG. 6 is a front view of the drawer assembly of FIG. 3 shown with locking bars thereof engaging a fresh food compartment door.

With reference to FIGS. 4-6, the drawer assembly 50 will now be described with respect to one example operation. In general, the drawer assembly 50 may be extended or retracted through the opening 47 (FIG. 3) formed in the fresh food compartment door 46 by operating the handle assembly 70 thereof. In particular, the handle assembly 70 is configured to cooperate with the latch assembly 80 for disengaging or retracting the locking bars 94*a*, 94*b* (FIG. 6) of the latch assembly 80 from blind holes or openings 47*a*, 47*b* formed in the fresh food compartment door 46, respectively, such that the drawer assembly 50 can be extended forward (e.g., unlocked) by a user. That is, in the locked condition, the front panel 60 is locked to the refrigerator door 46 via the locking bars 94*a*, 94*b* so that when a user opens the door 46 the front panel 60 is moveable together therewith. When the handle 72 (FIG. 4) is depressed by a user (e.g., pushed to the left as shown), the handle 72 will cause the reciprocating rod 74 to translate linearly (e.g., to the left as shown). Referring to FIG. 5A, this linear motion will cause the first link 86 to rotate clockwise as shown. Simultaneously, the second link 88 (keyed to the first link 86) will also rotate clockwise therewith, causing opposing ends 88*a*, 88*b* of the second link 88 to pull on the respective intermediate connectors 96*a*, 96*b* and locking bars 94*a*, 94*b*. Specifically, the intermediate connectors 96*a*, 96*b* and the locking bars 94*a*, 94*b* will translate vertically toward each other, thereby causing distal ends of the locking bars 94*a*, 94*b* (FIG. 6) to disengage from the blind holes or openings 47*a*, 47*b* formed in the fresh food compartment door 46. In this manner, the drawer assembly 50 will be unlocked such that it can be withdrawn from the fresh food compartment through the opening 47 in the fresh food compartment door 46.

Turning back to FIG. 4, when the handle 72 is depressed inwardly, it will also cause the magnet 77 disposed at a distal end of the rod 74 to move towards and actuate the switch 96 located in the front panel 60 of the drawer assembly 50. When actuated, the switch 96 will activate the moveable magnets 69 (FIG. 7A) disposed on the cantilevered arms 67 extending from a rear surface 60*b* of the front panel 60. When activated, these magnets 69 will attract corresponding magnets 104 or other magnetic material (i.e., ferromagnetic metal) disposed on opposing side walls of the basket 100 such that the basket 100 will be coupled to the front panel 60. The moveable magnets 69 can be actuated variously, such as by a solenoid or motor, so that they are caused to move towards the corresponding magnets 104 or other magnetic material disposed on opposing side walls of the basket 100. It is also contemplated that the front panel 60 could include a ferromagnetic metal while the opposing side walls of the basket 100 can include magnets. Yet, it is also contemplated that the basket 100 may be coupled to the front panel 60 via another form of moveable attachment structure, for example, a mechanical latch, slide, hook, or cam-lock, etc. that can be actuated to selectively couple and de-couple the front of the basket 100 to the rear of the front panel 60. It is also contemplated that the magnets 69 may be configured as electro-magnets that are held at a fixed position adjacent to the opposing side walls of the basket 100. Thus, the electro-magnets can be selectively energized (e.g., via the switch 96) when it is desired to couple the basket 100 to the front panel 60.

Referring back to FIG. 3, when the basket 100 is coupled to the front panel 60, pulling the drawer assembly 50 (e.g., by grasping the front panel 60 via the opening 62) will cause the basket 100 to be extended outwardly through the opening 47 in the fresh food compartment door 46*b*. In particular, the basket 100 is adapted to be withdrawn via the extendable slides 120 disposed on opposing sides thereof which provide physical support and a reduced friction interface between the basket 100 and the fresh food compartment 44 (i.e., compartment wall, central support structure). Preferably, the extendable slides 120 are supported at one side by the interior liner 24 of the refrigerator, and at the other side by a shelf or other structure of the cabinet. Yet, it is contemplated that the basket 100 may include another structure for providing a reduced friction interface between the basket 100 and fresh food compartment 44, e.g., ball-bearings, rollers, a sliding interface, etc.

When a user retracts the drawer assembly 50, for example, by pushing it back into the fresh food compartment 44, the front panel 60 will reengage the fresh food compartment door 46. Specifically, when the drawer assembly 50 is fully retracted and the handle 72 is released, the spring 79 (FIG. 4) will bias the handle 72 outwardly to its natural or resting position (e.g., to the right). This will cause the first and second links 86 and 88 (FIGS. 5A and 5B) to simultaneously rotate counterclockwise, thereby causing the intermediate connectors 96*a*, 96*b* and the locking bars 94*a*, 94*b* to translate vertically and away from each other. During this time, the distal ends of the locking bars 94*a*, 94*b* (FIG. 6) will reengage the respective openings 47*a* and 47*b* formed in the fresh food compartment door 46 such that the front panel 60 will be locked or secured thereto. It is further contemplated that the terminal ends of the locking bars 94*a*, 94*b* can have an angled, cam profile that is oriented to face the refrigerator door 46 so that engagement of the locking bars 94*a*, 94*b* with the front surface of the refrigerator door 46 will force the locking bars to translate into the front panel 60. In this configuration, the magnet 77 disposed at a distal end of the reciprocating rod 74 (FIG. 4) will be spaced apart from the switch 96 such that the magnets 69 disposed on the front panel 60 will be retracted, thereby decoupling the front panel 60 from the basket 100. Where electro-magnets are used, the electro-magnets can be selectively deenergized (e.g., via the switch 96) when it is desired to decouple the basket 100 to the front panel 60. The basket 100 will remain located within the interior of the fresh food compartment.

Yet in other embodiments, it is contemplated that retracting the drawer assembly 50 into the fresh food compartment 44 may cause the basket 100 to be decoupled from the front panel 60 via a door sensor, and the like. When decoupled from the basket 100, the fresh food compartment door 46 may be swung open (FIG. 7B) in a normal manner such that the front panel 60 of the drawer assembly 50 will move therewith. In other words, opening the fresh food compartment door 46 via the handle 45 (FIG. 3) attached thereto will also cause the front panel (engaged with the door 46) to rotate with the door 46.

The invention has been described with reference to the example embodiments described above. Modifications and alterations will occur to others upon a reading and understanding of this specification. Moreover, the drawer assemblies described herein may be adapted for placement in different refrigerator configurations (e.g., Top mount, side-by-side, etc.). Example embodiments incorporating one or more aspects of the invention are intended to include all such modifications and alterations insofar as they come within the scope of the appended claims and their equivalents.

What is claimed is:

1. A refrigerator appliance, comprising:

a storage compartment including a drawer assembly;

a refrigerator door coupled to the storage compartment to restrict or grant access to the storage compartment, wherein the door defines an opening that is shaped and dimensioned to enable the drawer assembly to be extended or retracted therethrough;

wherein the drawer assembly further comprises:

a front panel with a handle; and a container defining a storage space for food items;

wherein the handle is operable to selectively couple the container to the front panel such that the container may be extended or retracted through the opening in the refrigerator door, and wherein the front panel comprises a switch and the handle further comprises a reciprocating rod including a first magnet disposed at a distal end thereof, said first magnet being configured to actuate the switch and an electromagnet to selectively couple the front panel to the container.

2. The refrigerator appliance according to claim 1, wherein the switch is actuated upon making contact with the distal end of the reciprocating rod.

3. The refrigerator appliance according to claim 1, wherein the front panel comprises the electromagnet, and wherein the container comprises ferromagnetic material, wherein the handle is operable to activate the electromagnet such that the electromagnet is attracted to the ferromagnetic material of the container to couple the front panel to the container.

4. The refrigerator appliance according to claim 3, wherein the electromagnet is selectively magnetized when the handle is operated.

5. The refrigerator appliance according to claim 1, wherein the front panel comprises a movable magnet, and wherein the container comprises ferromagnetic material, wherein the movable magnet is configured to move toward ferromagnetic material of the container when the handle is operated.

6. The refrigerator appliance according to claim 1, wherein the front panel comprises a ferromagnetic material, and wherein the container comprises the electromagnet, wherein the handle is operable to activate the electromagnet such that the ferromagnetic material of the front panel is attracted to the electromagnet of the container to couple the front panel to the container.

7. A refrigerator appliance, comprising:

a storage compartment including a drawer assembly;

a refrigerator door coupled to the storage compartment to restrict or grant access to the storage compartment, wherein the refrigerator door defines an opening that is shaped and dimensioned to enable the drawer assembly to be extended or retracted therethrough;

wherein the drawer assembly further comprises:

a front panel with a handle; and a container defining a storage space for food items;

wherein the handle is operable to selectively couple the container to the front panel such that the container may be extended or retracted through the opening in the refrigerator door, wherein the handle further comprises a reciprocating rod, wherein the front panel further comprises a latch assembly including a locking bar that is selectively engaged with the refrigerator door, wherein the reciprocating rod causes the locking bar to disengage from the refrigerator door such that the drawer assembly may be extended through the opening of the refrigerator door when the handle is operated, and wherein the latch assembly further comprises:

a main body;

and a spring, wherein opposing ends of the spring are attached to the reciprocating rod and the main body, and wherein the spring is tensioned to urge the reciprocating rod to translate thereby causing the locking bar to engage the refrigerator door.

8. The refrigerator appliance according to claim 7, wherein the locking bar further comprises a first locking bar and a second locking bar that are configured to respectively disengage from a first and a second opening formed in the refrigerator door proximate an outer periphery of the opening when the handle is operated.

9. The refrigerator appliance according to claim 7, wherein the latch assembly further comprises:

a first link and a second link coupled to the first link, wherein the reciprocating rod is coupled to the first link, and wherein the locking bar is coupled to the second link, wherein the reciprocating rod causes the first link and the second link to simultaneously rotate when the handle is operated, thereby causing the locking bar to translate and disengage from the refrigerator door.

10. The refrigerator appliance according to claim 9, wherein the first link and the second link are coupled together via a keyed pin such that the second link is fixed relative to the first link and cannot rotate relative to the first link.

11. The refrigerator appliance according to claim 7, wherein the locking bar further comprises a first locking bar and a second locking bar, and wherein the refrigerator door defines a first opening and a second opening, and whereby when the spring urges the reciprocating rod to translate, the first and second locking bars respectively engage with the first and second openings of the refrigerator door.

12. The refrigerator appliance according to claim 7, wherein the latch assembly further comprises:

a first link and a second link coupled to the first link, wherein the reciprocating rod is coupled to the first link, and wherein the locking bar is coupled to the second link, and wherein opposing ends of the spring are connected to a tab extending from the main body of the latch assembly and the reciprocating rod, respectively, whereby when the spring urges the reciprocating rod to translate, the reciprocating rod causes the first link and the second link to simultaneously rotate, thereby causing the locking bar to engage the refrigerator door.

13. The refrigerator appliance according to claim 7, wherein the container includes extendable slides on opposing sides thereof that are configured to provide a reduced friction interface between the drawer assembly and the storage compartment such that the drawer assembly may be extended or retracted through the opening in the refrigerator door.

14. The refrigerator appliance according to claim 7, wherein a gasket is disposed at an interface of the opening of the refrigerator door and the front panel of the drawer assembly.

15. The refrigerator appliance according to claim 14, wherein the gasket is disposed at an outer periphery of the front panel.

16. The refrigerator appliance according to claim 14, wherein the gasket is disposed at an outer periphery of the opening of the refrigerator door.

17. The refrigerator appliance according to claim 7, wherein the front panel comprises an edge portion defining a recessed opening therein, and wherein the handle is disposed in the recessed opening.

* * * * *